US005152240A

United States Patent [19]

Fontanille

[11] Patent Number: 5,152,240

[45] Date of Patent: Oct. 6, 1992

[54] RETRACTABLE OR STORABLE THRUSTER USING A TRAPEZODIDAL DEFORMABLY ROTATABLE DEVICE PRODUCING RECTILINEAR MOVEMENT INSIDE A WELL

[76] Inventor: Guy Fontanille, 20 Avenue du Four, 83600 Les Adrets, France

[21] Appl. No.: 677,582

[22] Filed: Mar. 29, 1991

[51] Int. Cl.[5] ..... B63H 25/46

[52] U.S. Cl. ..... 114/151; 440/61; 440/63

[58] Field of Search ..... 440/53, 54, 61, 63, 440/67; 114/151-270

[56] References Cited

U.S. PATENT DOCUMENTS

| | | | |
|---|---|---|---|
| 2,949,791 | 8/1960 | Cattaneo et al. | 440/63 X |
| 3,127,865 | 4/1964 | Pleuger | 114/151 X |
| 3,765,368 | 10/1973 | Asbeck | 114/270 |
| 4,294,186 | 10/1981 | Wardell | 440/53 X |

FOREIGN PATENT DOCUMENTS

| | | | |
|---|---|---|---|
| 0001344 | 4/1979 | European Pat. Off. . | |
| 796669 | 4/1936 | France . | |
| 817303 | 9/1937 | France . | |
| 1573009 | 7/1969 | France . | |
| 1590321 | 5/1970 | France . | |
| 1601025 | 9/1970 | France . | |
| 2229608 | 12/1974 | France . | |
| 2243864 | 4/1975 | France . | |
| 2348850 | 11/1977 | France . | |
| 2571673 | 4/1986 | France | 440/61 |
| 379095 | 8/1932 | United Kingdom . | |
| 456632 | 11/1936 | United Kingdom . | |
| 2098136 | 11/1982 | United Kingdom . | |

OTHER PUBLICATIONS

"Max Power Les Propulseurs", model R300, Max Power.

"HPS Retractable Bow Thruster System", Hydra--Power Systems, Inc.

"Vosper Thornycroft Marine Thrusters", Vosper Thornycroft (UK) Ltd, Hydraulic Power.

"Marine Thrusters", Richfield Marine Thrusters Ltd.

"Max Power Retract R300", Max Power, B.P. 32 France 83600.

*Primary Examiner*—Sherman Basinger

*Attorney, Agent, or Firm*—Young & Thompson

[57] ABSTRACT

A retractable and storable thruster for a vessel, using a trapezoidal deformably rotatable device producing rectilinear movement inside a well in the vessel's hull. A casing (1) is sealingly fixed on joint planes in a well (2) which is an integral part of the structure (3) of the vessel. Within this casing (1) are folded two arms (4) and (5) pivoting asymmetrically, a motor (10), a stirrup (17) secured to the motor, and a propulsion screw assembly. The two arms (4) and (5), on the one hand, are pivoted at (6) and (7) on the casing (1) and, on the other hand, at (8) and (9) on the stirrup (17) secured to the motor (10). Under manual or mechanical action (X) or (Y) exerted on a lever (12) secured to the arm (4) by a shaft (6), this arm (4) in compound rotation with the triangulation arm (5) causes the deformation of the trapezium obtaining a rectilinear movement in a direction parallel to axis (A Z) of the motor (10) at its axis (11).

7 Claims, 4 Drawing Sheets

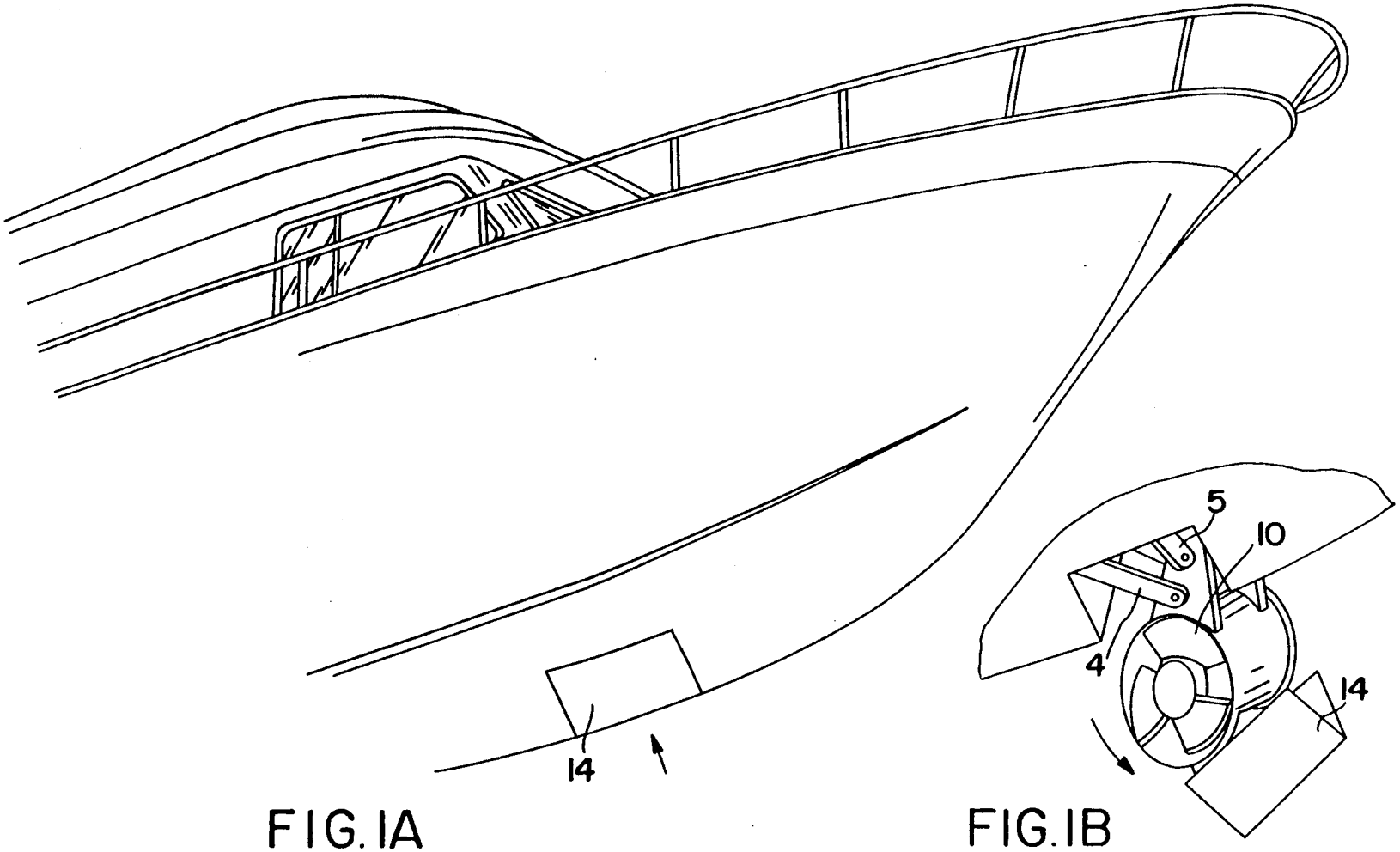
FIG. IB
FIG. IA

RETRACTABLE OR STORABLE THRUSTER USING A TRAPEZODIDAL DEFORMABLY ROTATABLE DEVICE PRODUCING RECTILINEAR MOVEMENT INSIDE A WELL

FIELD OF THE INVENTION

The invention comprises a retractable or storable thruster using a trapezoidal deformably rotatable device producing rectilinear movement inside a well.

The Known Prior Art

The state of the art can be defined by the following patents:

FR-A.2.348.850: This patent relates to a device for blocking a retractable boat thruster. The blockage in position of a retractable thruster is effected by means of four inclined articulated screws producing vertical and horizontal pressure components, and four articulated screws producing horizontal pressure. The invention is applicable to thrusters that are vertically retractable in a recess of a boat.

FR-A.1.573.009: This patent relates to a device for pressing on the stem post of a ship, comprising identical envelopes at each end which are connected to a central section, drive means disposed in the interior of the central section, a pair of axial shafts which can be rotated within the envelopes and driven selectively by said drive means, identical rotors on said shaft, and brakes means to lock one or the other of said rotors such that the drive means drive the unlocked rotor to provide a flow of water over the locked rotor functioning at this time as a stator.

FR-A.1.590.321: This patent provides means pressing on the stem post of ships, comprising a tunnel structure disposed transversely and located in the immersed body of the ship and containing at least one helix, said means having moreover the following characteristics taken alone or in combination:

1) the structure of the tunnel is in the form of a unit separate from the forward body of the ship and extending from one side to the other of its planking; moreover, it is articulated about a horizontal axis in said forward body, each lateral planking comprising an opening corresponding to that of the structure of the tunnel;

2) the structure of the tunnel is such as to pivot substantially 90° about a pivotal axis, and it comprises plate covers which cover the openings provided in the planking of the bulbous portion of the ship when the structure of the tunnel is located in its inoperative position;

3) the structure of the tunnel and/or the cover plates are provided with sealing devices adjustable and movable outwardly from the said pivotal axis and adapted to bear on the inner side of the planking.

FR-A.1.601.025: rotor device for the main stem of ships, having a bulbous main stem comprising an eduction channel extending from the forward planking of the ship, surrounding the propulsion member and splitting behind this latter into two branches oriented obliquely rearwardly, one toward starboard, the other toward port, then to the interior of the adjustable closure members, of which one of the characteristics is its use in ships comprising a bulbous hull and the other characteristic the mounting of the assembly of said device in the bulbous hull. The bulbous main stem is designed as a constructional unit comprising the hull rudder device, including or not the control motor of the propulsion member of said device, the assembly being connected to the hull of the ship.

FR-A.2.243.864: propulsion device for the tunnel and of variable thrust. The device comprises a fixed tunnel wall, a mobile portion of the tunnel, means to mount the movable portion in rotation on the fixed tunnel wall about the axis of this latter, means to drive in rotation said portion of the movable portion, a plurality of blades which extend inwardly from the movable wall portion, and which are connected to this latter so as to turn about the axis of the tunnel, and means to control the pitch of the blades relative to a plane perpendicular to the axis of the tunnel. Use in ships equipped with transverse tunnels provided forwardly or rearwardly on the waterline of these ships.

FR-A.2.229.608: This patent describes a motor, for example hydraulic, driving a shaft, vertical or inclined, in two portions, which can slide one relative to the other. The lower portion of this shaft drives a screw by means of a countershaft. This screw, thanks to sliding of the drive shaft, can be stored by raising it above the level of the water. This sliding can be brought about by a hydraulic jack controlled by the same oil under pressure as the hydraulic motor. The screw can be orientable to steer the boat. In raised position, retracted into a well provided for this purpose, the raisable portion can close this well so as to preserve for the hull of the ship its entire hydrodynamic performance.

These various patents describe "tunnel" or "retractable" thrusters specifically for the stem post or other portions of a ship.

"Tunnel" thrusters are fixed in the bottoms of the hulls of the ships, which usually has the drawback of leaving openings, creating turbulence which degrades the hydrodynamic performance. Other factors militate against "tunnel" thrusters. The rapid development of the shape of ship's hulls improves their hydrodynamics, tends to reduce the water resistance to the stem posts and stern, thereby decreasing the possibilities for installing these types of materials.

"Retractable" thrusters comprise generally a telescopic device effecting up and down movement, ensuring the exit of the helix of the thruster from the hull. These thrusters have major drawbacks. The telescopic rectilinear development of a column, implies by its provision an encumbrance and a heavy weight in the space of the ship. These telescopic movements of mechanical members have important problems in contact with water and in particular seawater, from accretions and barnacles, of jamming. Too high speed or a blow to the lowered thruster, damages it, preventing the raising of the system, generally preventing sailing without repair. As a result of prolonged non-use, these thrusters have a tendency to seize and no longer be operational.

These thrusters have as their function to have thrust in one direction or the other, lateral or longitudinal, but the majority of the "tunnel" or "retractable" thrusters do not have equal thrust in both directions, because the flow through a helix, even though symmetrical, suffers interference in one direction from its transmission base.

The invention aims to solve all these problems.

The invention is applicable particularly to all ships and other floating or submersible machines.

SUMMARY OF THE INVENTION

The present invention relates to a storable or retractable transverse or longitudinal propulsion device, useful in floating or submersible vessels.

The lateral devices of bidirectional propulsion, combined with conventional forward and rearward steps, make possible omnidirectional displacement of the engine equipment, precise positioning during maneuvering, and correction of drift due to wind and current or momentum. Positioned in the submerged hull of a ship, these devices are called retractable or storable thrusters.

The thruster according to the invention is retractable or storable, utilizing a trapezoidal deformably rotatable device effecting a rectilinear exit and re-entrance movement from and back into the interior of a well.

The total space taken up by this thruster, particularly when raised, can be less by three or four times that of a conventional "retractable" thruster.

The total space necessary for this thruster may be equal to or less than that of a "tunnel" thruster.

This thruster according to the invention is provided with two screws; the first screw is tractive, supercharging the second screw which is propulsive, and vice versa by reversal of the direction of rotation, rendering the assembly very effective with a symmetrical thrust in both directions.

The propulsion assembly according to the invention, by virtue of its design and arrangement, provides great rigidity.

By its design and construction, this thruster is not subject to seizing.

Because of its design and construction, in case of shock or too high speed, this thruster stores itself within the engine compartment.

The features of the present thruster, because of its compact design and its implementation, favor its internal installation, so as to be light and rigid. Its symmetrical helicoidal propulsion assembly gives it high output equal in the two directions. Out of service and for safety, this device is retracted or stored, locked, within a well automatically closed by a trap door whose external shape reproduces that of the hull, reducing hydrodynamic losses, by the total elimination of all sources of parasitic turbulence.

The device according to the present invention is comprised by a compartment, secured in sealed fashion in a well comprising an integral part of the structure of the engine compartment. In the interior of this casing are folded two asymmetric pivoting arms, a motorized base and a screw assembly. The two arms, on the one hand, are pivoted on the casing, and, on the other hand on the thruster base. Under mechanical or manual action on the lever secured to the principal arm by its axle, said arm in compound rotation with the triangulation arm produces rectilinear movement. The deformation thus imparted to the trapezium comprised by the four pivotal connections gives rise to an exit or re-entrant motion of the base by the center of the screw assembly.

According to a preferred embodiment, the exit or reentry movement is rectilinear with respect to the center of the screw assembly.

The propulsion base is provided with two screws, the first screw is tractive, supercharging the second screw which is propulsive, and vice versa upon reversal of rotation, rendering the assembly very efficient with symmetrical thrust in the two directions.

The base is comprised of:

a stirrup a nozzle which provides protection with a trap door support a screw assembly.

The screw assembly is comprised of:

a mechanical casing with oil bath, with a transmission shaft a conical coupling, and shaft for one or two screws a hydraulic, electric or compressed air sealed motor.

The operation of exiting and reentering is controlled from outside the casing, by a hydraulic, electric, compressed air or manual system.

Automatic locking and unlocking in the return position prevents operation without remote control by the user. This coupling is also manual to control operation or in the event of misfunction. The use of said lock is in combination with the lever and with the sliding cover.

BRIEF DESCRIPTION OF THE DRAWINGS

The accompanying drawings are given by way of illustrative example and are not limiting. They show a preferred embodiment according to the invention, and they permit easy comprehension of the invention.

FIG. 1A is a perspective view of a boat hull, with the thruster retracted and its trap door closed.

FIG. 1B is a detail view of the region indicated by the arrow in FIG. 1A, showing the thruster extended.

DETAILED DESCRIPTION OF THE INVENTION

Figure 3:
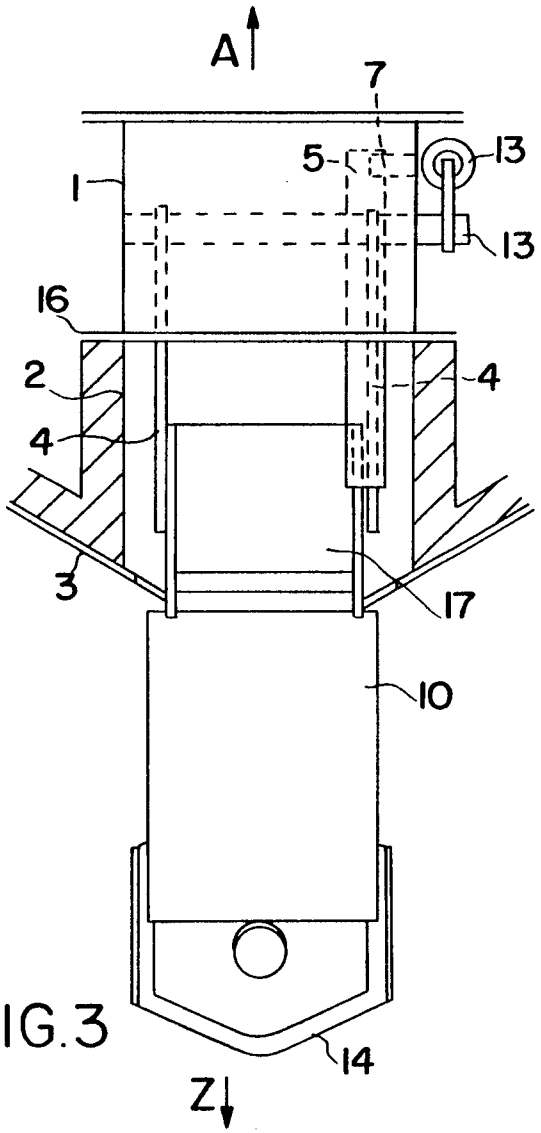
FIG. 3 is a schematic rear view of the extended thruster.
Figure 2:
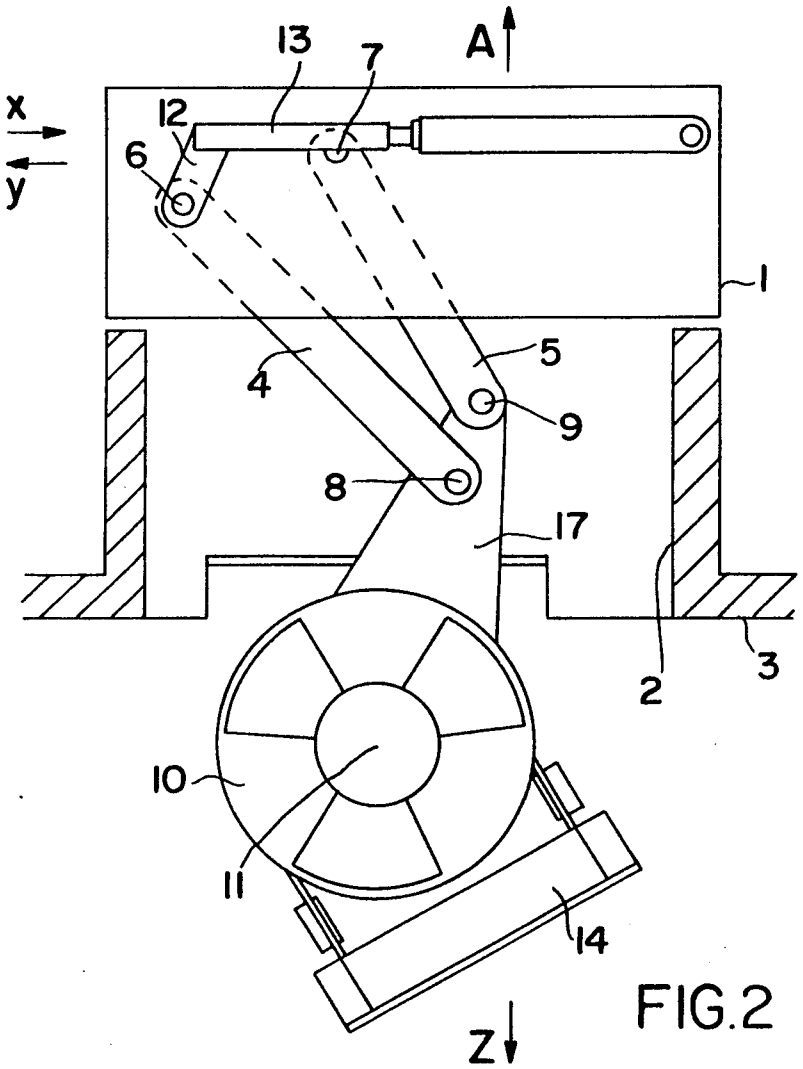
FIG. 2 is a schematic side view of the extended thruster.
Figure 5:
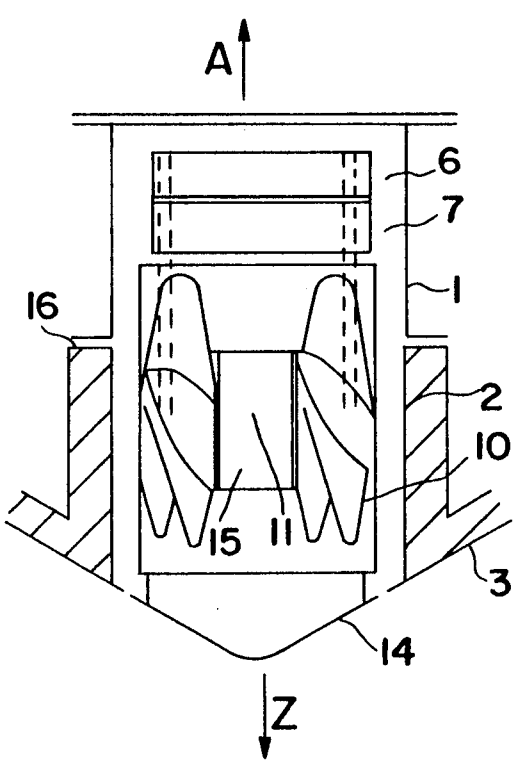
FIG. 5 is a schematic view from the rear of the retracted thruster.
Figure 4:
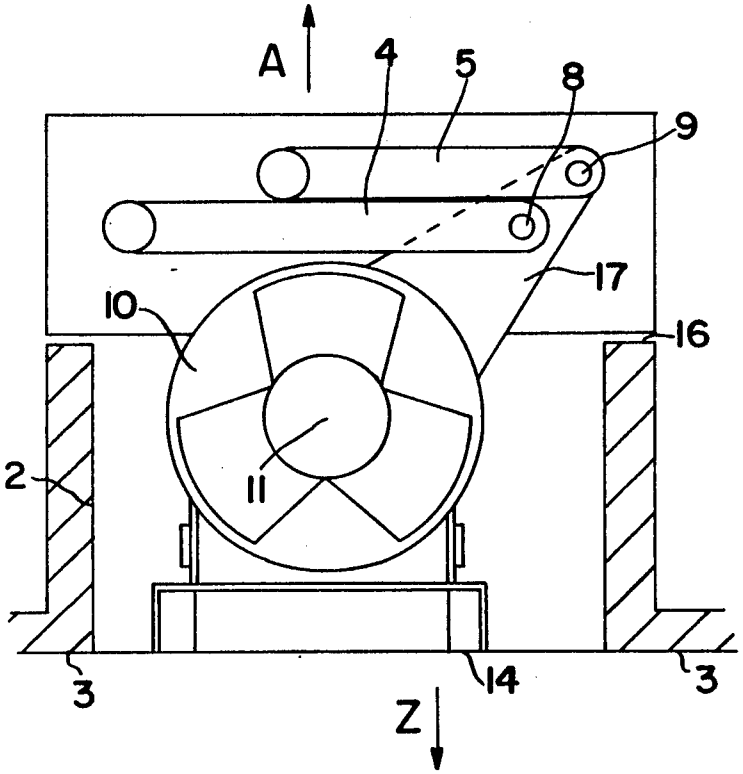
FIG. 4 is a schematic side view of the retracted thruster.
Figure 6:
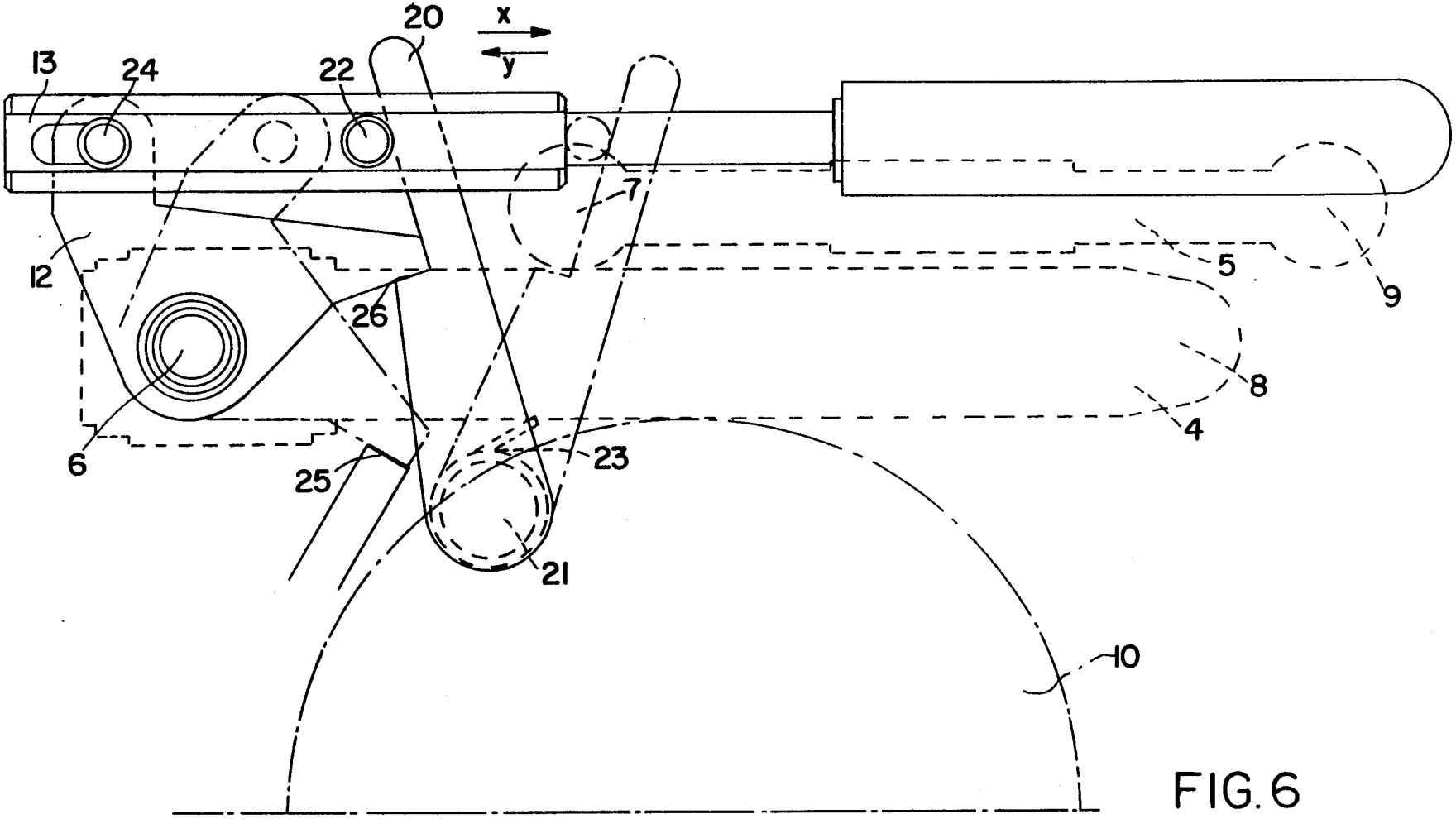
FIG. 6 is a side schematic view of the lock.

The invention relates to a storable thruster. Thanks to its compact design and its manner of embodiment, its installation is very easy in limited spaces.

It is comprised by a casing 1, sealingly secured along the plane of joint 16, on a well 2 comprising an integral portion of the structure 3 of the engine compartment. Within the casing 1 are folded two arms 4 and 5 pivoting symmetrically, a motorized base 10, a stirrup 17 and a screw assembly 15. The two arms 4 and 5, on the one hand, are pivoted at 6 (shaft of the control arm) and 7 (shaft of the triangulation arm) on casing 1 and, on the other hand, at 8 and 9 on the stirrup 17 secured to the propulsion base 10, and the four points 6–9 define a trapezoidal linkage. Under mechanical action X or Y exerted on lever 12 secured to arm 4 by shaft 6, said arm 4 in compound rotation with the triangulation arm 5 imparts deformation to the trapezium, thereby obtaining rectilinear movement along axis A Z of the base 10 at its center 11.

The use of the thruster has five phases:

Process of unlocking and placing in operation

Under the mechanical or manual action X, the cover 13 slides, producing, by the abutment 22, pressure on the hook 20, this latter pivoting about 21, freeing the seat 26, thus triggering the extension.

Extension

Continuing the action X on the cover 13 imposes, by axle 24, a traction on the cam lever 12, said lever 12 being secured by shaft 6 of control arm 4; and this latter, in compound rotation with the triangulation arm 5, causes the extension of the base 10 as well as the simultaneous opening of trap door 14, and then at the end of the movement, causes the abutment of seat 26 with 25.

Propulsion

Propulsion is effected by controlled right hand or left hand rotation of the screw assembly 15.

Retraction

Under the mechanical or manual action Y, the cover 13 slides, causing by axle 24 a pressure on lever 12, said lever 12 being secured by shaft 6 of the control arm 4, this latter, in compound rotation with the triangulation arm 5, causes the retraction of the base 10, and the simultaneous closing of trap door 14, as well as triggering locking.

Locking process

Continuing pressure in the direction Y against cover 13, causes by axle 24 a pressure on cam lever 12, and said lever 12 will be, at the end of rotation and at the end of movement jammed as shown at 26 by the hook 20, said hook 20 rotating about 21 being itself returned by its spring 23.

What is claimed is:

1. A retractable and storable thruster for use with a vessel, comprising a casing adapted to be secured to the hull of a vessel, an asymmetrical trapezoidal linkage comprising two arms pivotally connected at two spaced points to the casing and at two spaced points to a stirrup, a motor carried by the stirrup, a propulsion screw driven by the motor, and means to deform the parallelogram linkage to extend the screw assembly out from the hull of the vessel in one direction and to retract the screw assembly into the hull of the vessel in the other direction, the asymmetric trapezoidal linkage being so connected to the casing and the stirrup that the movement of the center of the propulsion screw assembly, upon extension or retraction thereof, is rectilinear.

2. A thruster as claimed in claim 1, wherein said two arms vertically overlie the propulsion screw assembly in the retracted position thereof.

3. A thruster as claimed in claim 2, wherein said arms are substantially parallel to each other in said retracted position.

4. A thruster as claimed in claim 1, wherein said points at which the arms are pivotally connected to the casing are farther apart than said points at which said arms are pivotally connected to the stirrup.

5. A thruster as claimed in claim 1, wherein said arms are of different lengths.

6. A thruster as claimed in claim 1, wherein an imaginary line interconnecting said points at which said arms are connected to said stirrups makes a larger angle with the path of extension and retraction movement of the center of the propulsion screw assembly when said propulsion screw assembly is retracted than when said propulsion screw assembly is extended.

7. A thruster as claimed in claim 1, wherein said stirrup is elongated and forms a greater angle with the path of extension and retraction movement of the center of the propulsion screw assembly when said propulsion screw assembly is retracted than when said propulsion screw assembly is extended.

* * * * *